US006341610B1

(12) United States Patent
Chuan

(10) Patent No.: US 6,341,610 B1
(45) Date of Patent: Jan. 29, 2002

(54) MULTI-BLADE CIGAR CUTTING DEVICE

(76) Inventor: Chin-Chung Chuan, No. 183, Sec. 2, Shu-Lin St., Tainan City (TW)

( * ) Notice: Subject to any disclaimer, the term of this patent is extended or adjusted under 35 U.S.C. 154(b) by 0 days.

(21) Appl. No.: 09/605,286

(22) Filed: Jun. 28, 2000

(51) Int. Cl.[7] ..... A24F 13/24
(52) U.S. Cl. ..... 131/248; 131/329
(58) Field of Search ..... 131/248, 250, 131/329

(56) References Cited

U.S. PATENT DOCUMENTS 5,765,569 A * 6/1998 Kemanjian ..... 131/248
5,862,808 A * 1/1999 Albarello ..... 131/255

* cited by examiner

*Primary Examiner*—Christopher A. Fiorilla
(74) *Attorney, Agent, or Firm*—Charles E. Baxley

(57) ABSTRACT

A cigar cutting device includes a rod with a bottom disk on an end and a kick member on the other end of the rod. A first tube with a first tubular blade is movably mounted to the rod and an operation disk is connected to the first tube. The first tube has a flange extending radially outward from the first tube and a second tube is movably mounted to the first tube. The flange engages with an inner periphery of the second tube. A second tubular blade is connected to the second tube and encloses the first tubular blade. The first tubular blade and the second tubular blade can be alternatively used to cut cigars with different sizes by moving the first tube and the second tube relative to each other.

6 Claims, 4 Drawing Sheets

MULTI-BLADE CIGAR CUTTING DEVICE

FIELD OF THE INVENTION

The present invention relates to a cigar cutting device, and more particularly, to a cigar cutting device having multiple blades retractably received therein for cutting cigars with different sizes.

BACKGROUND OF THE INVENTION

A conventional cigar cutting device is shown in FIG. 4 and generally includes a tubular body 11 and an annular blade 13 which is connected to an end of the tubular body 11. A cap 12 is mounted to the tubular body 11 and encloses the annular blade 13. The annular blade 13 has a fixed size so that only the cigars having a fixed size can be cut by the cutting device. However, the cigar lovers usually enjoy cigars made by different manufacturers and having different sizes so that the cigar cutting device having one size cannot meet the requirements of the users.

The present invention intends to provide a cigar cutting device that has two tubular blades to cut cigars with different sizes and occupies a limited space.

SUMMARY OF THE INVENTION

The present invention relates to a cigar cutting device which comprises a rod having a bottom disk and a kick member respectively connected to two ends thereof. A first tube is mounted to the rod and an operation disk and a first tubular blade are respectively connected to two ends of the first tube. A flange extends radially outward from the first tube and the kick member is movably received in the first tubular blade. A second tube is movably mounted to the first tube and the flange is movably engaged with an inner periphery of the second tube. A second tubular blade is connected to an end of the second tube and encloses the first tubular blade.

The primary object of the present invention is to provide a cigar cutting device that has two tubular blades with different sizes and the two blades are retractably connected with each other so that the cigar cutting device has a compact size.

These and further objects, features and advantages of the present invention will become more obvious from the following description when taken in connection with the accompanying drawings which show, for purposes of illustration only, several embodiments in accordance with the present invention.

DESCRIPTION OF THE PREFERRED EMBODIMENT

Figure 1:
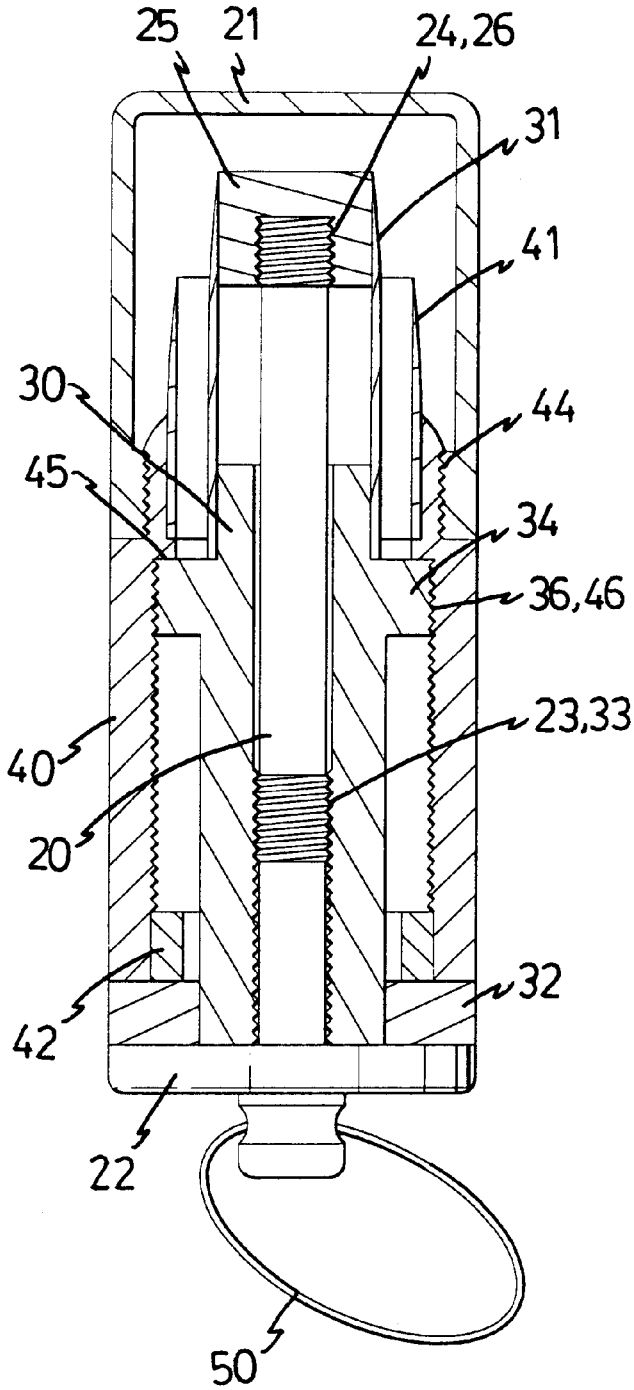
FIG. 1 is a cross sectional view to show a cigar cutting device of the present invention.

Referring to FIG. 1, the cigar cutting device in accordance with the present invention comprises a rod 20 having a bottom disk 22 on a first end thereof and a threaded portion on a second end of the rod 20 so as to be connected to a kick member 25. A ring 50 is connected to the bottom disk 22 and a threaded section 23 is defined in an outer periphery of the rod 20. A first tube 30 is mounted to the rod 20 and an operation disk 32 is connected on a first end of the first tube 30. A first threaded inner periphery 33 is defined in an inner periphery of the first tube 30 and the threaded section 23 of the rod 20 is engaged with the first threaded inner periphery 33. A first tubular blade 31 is connected to a second end of the first tube 30. A flange 34 extends radially outward from the first tube 30 and the kick member 25 is movably received in the first tubular blade 31 when rotating the bottom disk 22. A threaded outer periphery 36 is defined in an outer periphery of the flange 34.

Figure 3:
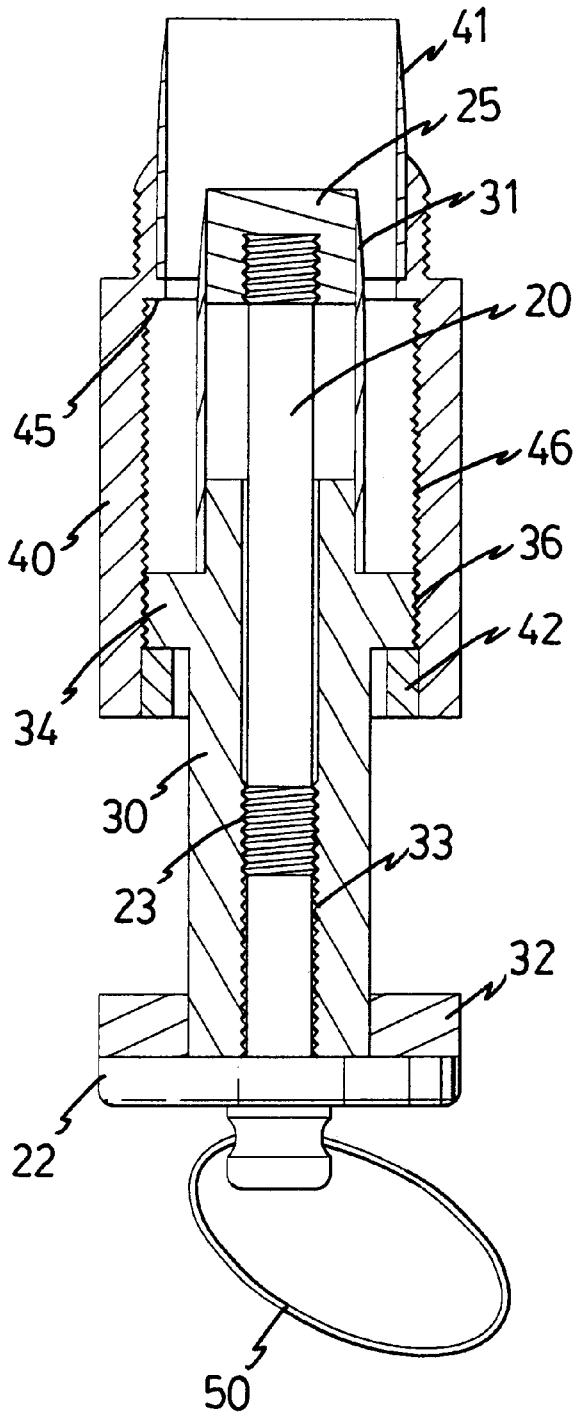
FIG. 3 is a cross sectional view to show the cigar cutting device of the present invention, wherein a second tubular blade is to be used.
Figure 4:
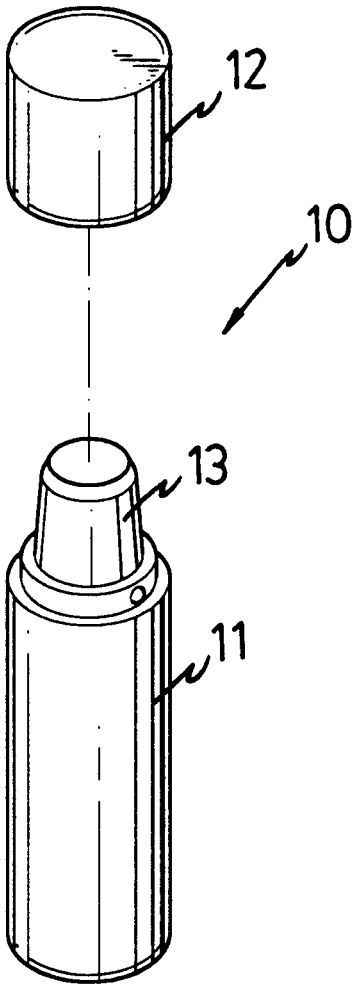
FIG.4 PRIOR ART
FIG. 4 is an exploded view to show a conventional cigar cutting device.

A second tube 40 is movably mounted to the first tube 30 and a second threaded inner periphery 46 is defined in the inner periphery of the second tube 40. The threaded outer periphery 36 on the flange 34 is engaged with the second threaded inner periphery 46 of the second tube 40 so that the flange 34 together with the first tube 30 are movably engaged with the inner periphery of the second tube 40 as shown in FIG. 3 by rotating the operation disk 32. A second tubular blade 41 is connected to an end of the second tube 40 and encloses the first tubular blade 31. A stop ring 42 is connected to the inner periphery of the second tube 40 so as to prevent the flange 34 from dropping from the second tube 40. An inward flange 45 extends from the inner periphery of the second tube 40 and is located close to the second tubular blade 41 so that the flange 34 will be stopped when the second tube 40 is located at its lowest position as shown in FIG. 1. A cap 21 is threadedly connected to the second tube 40 so as to enclose the first tubular blade 31 and the second tubular blade 41.

Figure 2:
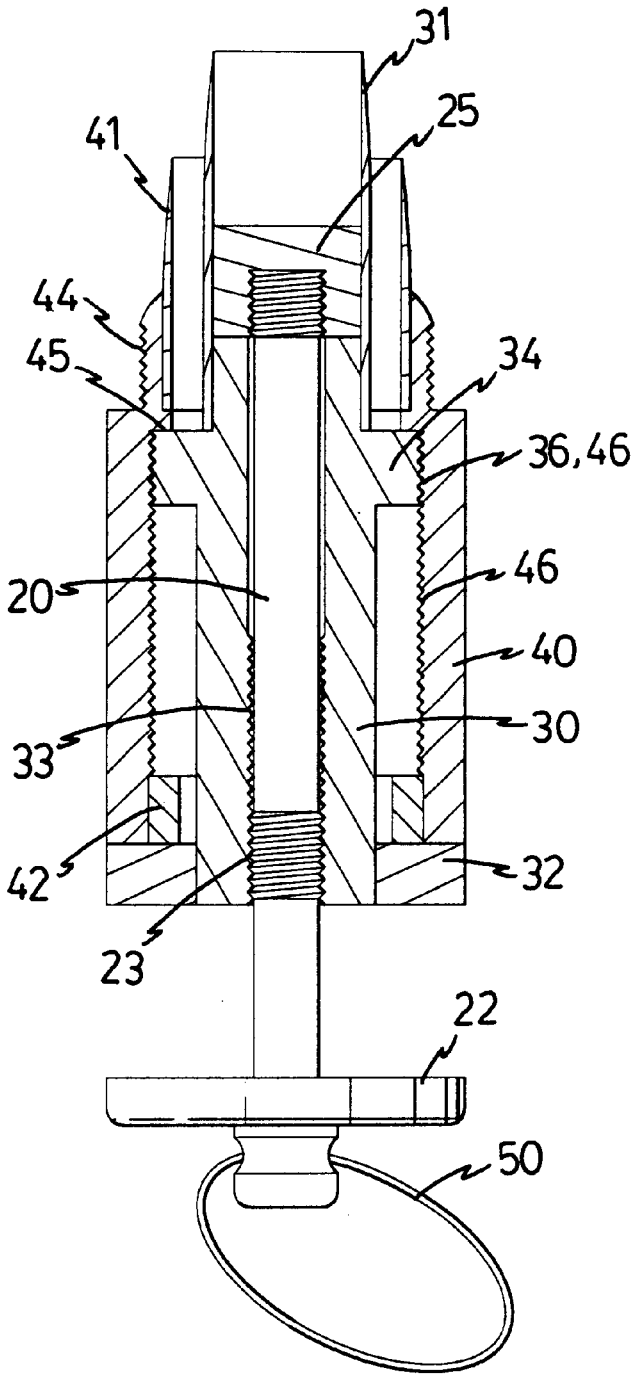
FIG. 2 is a cross sectional view to show the cigar cutting device of the present invention, wherein a first tubular blade is to be used.

When in use, as shown in FIGS. 2 and 3, the first tubular blade 31 can be used by rotating the bottom disk 22 and the kick member 25 is lowered. By rotating the operation disk 32, the second tubular blade 41 is ready for being used. The kick member 25 is used to kick the remaining portion of the cigar in the first/second tubular blade 31/41.

While we have shown and described an embodiment of the present invention, it should be clear to those skilled in the art that further embodiments may be made without departing from the scope of the present invention.

I claim:

1. A cigar cutting device comprising:

a rod having a bottom disk on a first end thereof and a kick member connected to a second end of said rod;

a first tube mounted to said rod and an operation disk on a first end of said first tube, a first tubular blade connected to a second end of said first tube, a flange extending radially outward from said first tube and said kick member movably received in said first tubular blade, and a second tube movably mounted to said first tube and said flange movably engaged with an inner periphery of said second tube, a second tubular blade connected to an end of said second tube and enclosing said first tubular blade.

2. The cigar cutting device as claimed in claim 1 further comprising a threaded section defined in an outer periphery of said rod and a first threaded inner periphery defined in an inner periphery of said first tube, said threaded section of said rod engaged with said first threaded inner periphery.

3. The cigar cutting device as claimed in claim 1 further comprising a threaded outer periphery defined in an outer periphery of said flange and a second threaded inner periphery defined in said inner periphery of said second tube, said threaded outer periphery on said flange engaged with said second threaded inner periphery of said second tube.

4. The cigar cutting device as claimed in claim 1 further comprising a cap connected to said second tube to enclose said first tubular blade and said second tubular blade.

5. The cigar cutting device as claimed in claim 1 further comprising a ring connected to said bottom disk.

6. The cigar cutting device as claimed in claim 1 further comprising a stop ring connected to said inner periphery of said second tube and located away from said second tubular blade, an inward flange extending from said inner periphery of the second tube and located close to said second tubular blade.

* * * * *